US005931147A

United States Patent [19]

Nakazato et al.

[11] Patent Number: 5,931,147

[45] Date of Patent: Aug. 3, 1999

[54] METHOD OF CUTTING A WORKPIECE WITH A WIRE SAW

[75] Inventors: Yasuaki Nakazato, Koshoku; Noriaki Kubota, Nagano; Hisakazu Takano, Nagano; Mitsufumi Koyama, Nagano, all of Japan

[73] Assignee: Shin-Etsu Handotai Co., Ltd., Tokyo, Japan

[21] Appl. No.: 08/822,087

[22] Filed: Mar. 20, 1997

[30] Foreign Application Priority Data

Mar. 27, 1996 [JP] Japan ..... 8-097703

[51] Int. Cl.[6] ..... B28D 1/06

[52] U.S. Cl. ..... 125/16.02; 125/21

[58] Field of Search ..... 125/12, 16.01, 125/16.02, 21; 83/651.1

[56] References Cited

U.S. PATENT DOCUMENTS 2,385,287 9/1945 Le Van .

3,395,204 7/1968 Olsson et al. .

FOREIGN PATENT DOCUMENTS 7-52149 2/1995 Japan .

9-38854 2/1997 Japan .

*Primary Examiner*—Timothy V. Eley

*Attorney, Agent, or Firm*—Oliff & Berridge, PLC

[57] ABSTRACT

There is disclosed a method of slicing a semiconductor ingot in which the ingot is pressed against a moving wire. A thinner portion of the wire is used at the beginning of slicing to cut a portion of the ingot where the cutting length is shorter than a predetermined length, and a thicker portion of the wire is used when the cutting length becomes longer than the predetermined length. Subsequently, a thinner portion of the wire is used when the slicing approaches to the end and the cutting length becomes shorter than a predetermined length. A portion of the wire used in previous slicing is used as the thinner portion. Alternatively, the thinner portion is formed through use of a die. The slicing method makes it possible to cut the ingot into a plurality of wafers having a uniform thickness.

19 Claims, 3 Drawing Sheets

METHOD OF CUTTING A WORKPIECE WITH A WIRE SAW

BACKGROUND OF THE INVENTION

1. Field of the Invention

The present invention relates to a method of cutting a workpiece with a wire saw, for example, for slicing wafers from a semiconductor silicon ingot.

2. Description of the Related art

Conventionally, there is known a method of slicing a cylindrical ingot of semiconductor material such as silicon, GaAs, etc. to form a plurality of circular disc-shaped wafers, wherein a single thin steel wire is spirally wound with tension around a plurality of parallel rollers at a predetermined pitch, and the wire is moved unidirectionally or reciprocally. When the wire is moved reciprocally, the distance over which the wire is advanced is slightly larger than the distance over which the wire is retracted, so that a new portion of the wire is pulled out every time. The ingot is pressed against the wire, while abrasive grain slurry is fed to the areas of contact between the ingot and the wire. Since this method makes it possible to cut out many wafers simultaneously, recently this method has commonly been used instead of the conventional method using an inner diameter slicer.

However, the wire becomes worn due to the abrasive grains and other causes while the wire reciprocates, and the wear amount depends on the cutting length of the workpiece. The cutting length of the workpiece is the length of the cut portion of the workpiece in contact with the wire. When the workpiece has a circular cross section, the cutting length is short at the beginning and end of slicing and is longest when the center portion of the workpiece is cut. Therefore, as shown in FIG. 5B, when the wire 1 cuts the central portion of the workpiece, the wire 1 becomes thinner compared to the case where the wire 1 cuts the upper and lower portions at the beginning and end of slicing. Accordingly, the cutting thickness (the thickness of the removed portion) changes along the cutting direction, so that the sliced wafers W come to have a nonuniform thickness, being thicker in the central part.

The wafers W of non-uniform thickness require a great amount of lapping in a subsequent lapping stage, which causes greater loss of the material of the workpiece.

SUMMARY OF THE INVENTION

The present invention has been accomplished to solve the above-mentioned problem, and it is an object of the invention to provide a method of slicing a workpiece such as a silicon ingot, which makes it possible to slice the workpiece into a plurality of plates, such as wafers, having a uniform thickness without causing changes in the cutting thickness from the beginning to the end.

The present invention provides a method of slicing a workpiece in which a cylindrical workpiece is pressed against a moving wire so as to cut out plates having a substantially circular shape. A thinner portion of the wire is used at the beginning of slicing to cut a portion of the workpiece where the cutting length is shorter than a predetermined length, and a thicker portion of the wire is used when the cutting length becomes longer than the predetermined length.

The present invention also provides a method of slicing a workpiece with a wire saw in which a thinner portion of the wire is used at the end of slicing to cut a portion of the workpiece where the cutting length is shorter than a predetermined length.

The present invention further provides a method of slicing a workpiece with a wire saw in which a thinner portion of the wire is used at the beginning and end of slicing to cut corresponding portions of the workpiece where the cutting length is shorter than a predetermined length, and a thicker portion of the wire is used to cut the center portion of the workpiece where the cutting length is longer than the predetermined length.

When circular plates with circular cutting surfaces are sliced from a cylindrical workpiece using a wire, the cutting length is initially zero and increases to a maximum when the wire cuts the center of the cylinder, then decreases to zero at the end. The wear amount of the wire varies in proportion to the cutting length. Therefore, when the cutting length is shorter than a predetermined length, the wear amount of the wire is relatively small and the wire is maintained relatively thick. When the cutting length is longer than the predetermined length, the wear amount of the wire becomes relatively large and the wire becomes relatively thin. As a result, as shown in FIG. 5B, the cutting thickness becomes relatively large where the wear amount of the wire is relatively small so that the thickness of the circular plate at that portion tends to decrease, whereas the cutting thickness becomes relatively small where the wear amount of the wire is relatively large so that the thickness of the circular plate at that portion tends to increase.

According to the present invention, the portion of the workpiece where the cutting length is shorter than a predetermined length is cut with a thinner portion of the wire, whereas the portion of the workpiece where the cutting length is longer than the predetermined length is cut with a thicker portion of the wire. As a result, the diameters of portions of the wire used to cut the workpiece become the same during the slicing operation, so that the cutting thickness becomes uniform.

Preferably, the wire is rewound so as to use a used portion of the wire as the thinner portion for cutting the portion of the workpiece where the cutting length is shorter than the predetermined length. Alternatively, the moving direction of the wire is reversed so as to use a used portion of the wire as the thinner portion for cutting the portion of the workpiece where the cutting length is shorter than the predetermined length. Since the used portion of the wire is used again, it is economical.

The portion of the wire that was used is used again at the beginning and end of slicing, and a new portion of the wire is used when the intermediate region is being cut. This is because the portion of the wire that was used is usually thinner than the new portion of the wire, due to wearing out. Specifically, at the beginning, a portion of a wire that was used for cutting the preceding workpiece may be used either after rewinding, or after reversing the moving direction of the wire. Near the end of slicing, the wire is rewound or the moving direction is reversed, and the used portion of the wire is used again.

In the method according to the present invention, a die may be used for forming the thinner portion of the wire.

The die may be a roller die including a plurality of rollers. Alternatively, the die may be a pulling die having a certain shape of a hole through which a wire material is pulled. The die is used to make a portion of a wire thinner when it is required.

In this case, since a selected portion of the wire can be more precisely machined to have a predetermined diameter through selection of a die, precise machining is guaranteed.

In the method according to the present invention, it is preferred that the thinner portion of the wire is used at the beginning of slicing until the cutting length becomes greater than approximately 50% of the outer diameter of the workpiece.

It is also preferred that the thinner portion of the wire be used near the end of slicing after the cutting length becomes equal to or less than approximately 50% of the outer diameter of the workpiece.

When the thinner portion of the wire is used where the cutting length is equal to or less than approximately 50% of the outer diameter of the workpiece, the cutting length becomes substantially uniform, and the thickness profile of the sliced wafers becomes much more uniform compared with the wafers sliced by the above-described conventional method.

In the method according to the present invention, the cylindrical workpiece is preferably a semiconductor ingot, in particular, a semiconductor silicon ingot.

BRIEF DESCRIPTION OF THE DRAWINGS

FIGS. 2A and 2B are explanatory views showing the slicing method according to the present invention, wherein FIG. 2A shows the diameter of a wire at each cutting portion at the beginning of slicing, while FIG. 2B shows the diameter of the wire at each cutting portion at the end of slicing;

FIGS. 5A and 5B are explanatory views showing a conventional slicing method, wherein FIG. 5A shows the diameter of a wire at each cutting portion at the beginning of slicing, and FIG. 5B shows the diameter of the wire at each cutting portion at the end of slicing.

DESCRIPTION OF THE PREFERRED EMBODIMENT

An embodiment of the invention will now be described in detail with reference to the drawings.

Figure 1B:
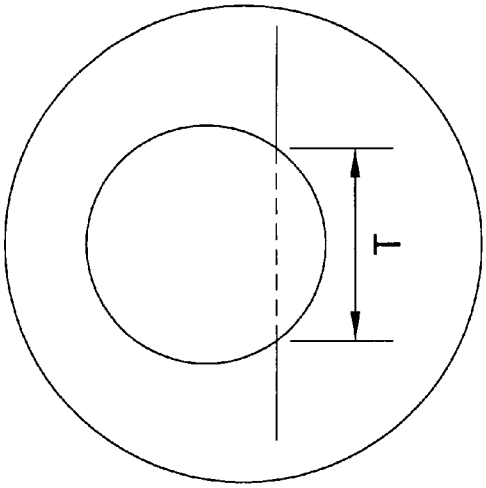
FIGS. 1A and 1B are explanatory views illustrating a method of slicing a workpiece with a wire saw.
Figure 1A:
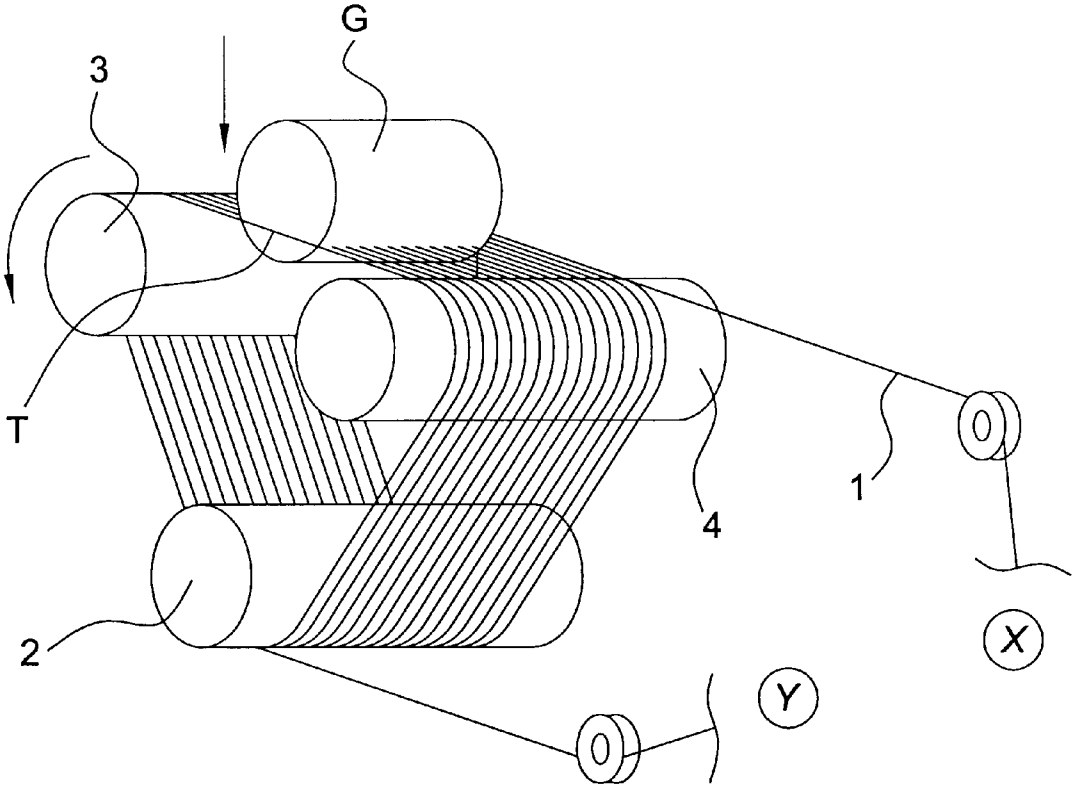

The method of slicing with a wire saw according to the present invention may be applied when many wafers W are simultaneously cut out from a silicon ingot G produced, for example, by the single crystal pulling method. As shown in FIGS. 1A, and 1B in the slicing method with a wire saw, a steel wire 1 is pulled out from a wire feeder-side X and is spirally wound around three rollers 2, 3, and 4 at a predetermined pitch and pulled out to a wire winder-side Y. The wire 1 is moved by the lower roller 2 at a certain linear speed, while a cylindrical ingot G is pressed downward against portions of the wire 1 between the upper rollers 3 and 4, and abrasive grain slurry (oily or water soluble coolant in which fine abrasive grains are suspended) is fed to the areas of contact between the wire 1 and the ingot G. Thus, the wire 1 cuts the ingot G in its radial direction.

One method of moving the wire 1 is to simply move the wire 1 in one direction from the wire feeder-side X to the wire winder-side Y. Another method is to move the wire 1 reciprocally by reversing the rotational direction of the driving roller 2 periodically such that the wire 1 resultantly advances at a predetermined speed. For example, the wire 1 is moved forward at a predetermined line speed for A seconds, and then moved backward at the same line speed for (A−α) seconds, so that the wire 1 is resultantly fed by a distance corresponding to α seconds every (2A−α) seconds. The present invention can be applied to both of the above-described cutting methods.

The cutting method using a wire saw is effective because many wafers are sliced simultaneously, but it has a drawback that the thickness of the wafers are apt to change along the cutting direction, compared with conventional slicing methods such as a method using a slicer with an inner diameter blade. One cause of the change in the thickness of the wafer sliced by the wire saw is the change in the wear amount of the wire 1.

Figure 3:
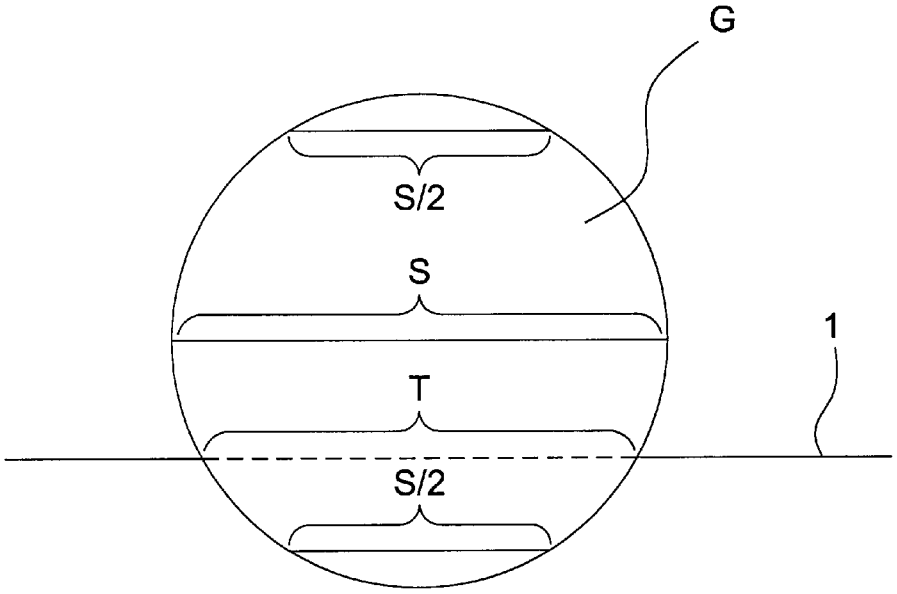
FIG. 3 is an explanatory diagram showing cutting length regions where a thinner portion of the wire is used.

The reason for the change in the wear amount of the wire 1 is as follows. When wafers W are sliced from a cylindrical ingot, the cutting surfaces of the wafer become substantially circular. In this case, as shown in FIG. 3, the cutting length T representing the length of contact between the wire 1 and the wafer W changes, so that the wear amount of the wire 1 becomes relatively small where the cutting length is relatively short, whereas the wear amount of the wire 1 becomes relatively large where the cutting length is relatively long.

Figure 5A:
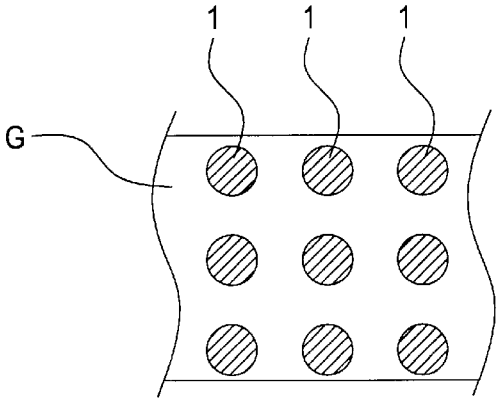
FIG. 5A (RELATED ART)
Figure 5B:
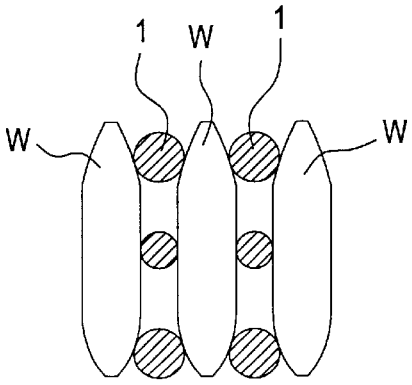
FIG. 5B (RELATED ART)

The diameter of the wire 1 changes in accordance with the wear amount. For example, if various parts of the workpiece are cut by different portions of wire having the same initial diameter, as shown in FIG. 5A (which shows cutting at the upper, center and lower portions), the portions of the wire 1 have different diameters at the end of slicing as shown in FIG. 5B. Specifically, when the wire 1 cuts the upper or the lower portions where the cutting length T is relatively short, the diameters of the corresponding portions of the wire 1 do not become much thinner. In contrast, when the wire 1 cuts the central portion where the cutting length T is relatively long, the diameters of the corresponding portions of the wire become much thinner Therefore, the thickness of the wafers W could not be made uniform.

Figure 2A:
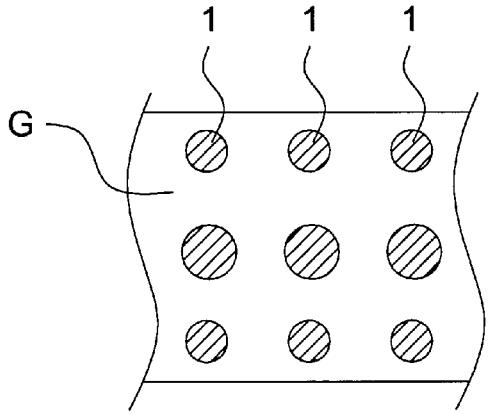
Figure 2B:
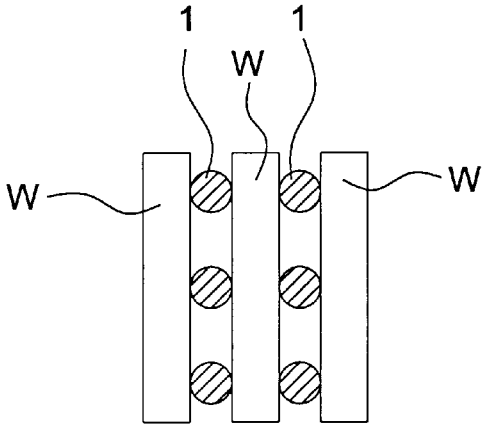

In the present embodiment, the diameter of the wire 1 at the beginning of slicing is changed in accordance with the locations of the ingot G, as shown in FIG. 2A (which shows cutting at the upper, center, and lower portions), so that all the diameters of the corresponding portions of the wire 1 may become the same at the end of slicing, as shown in FIG. 2B. A thinner portion of the wire 1 is used where the cutting length T is equal to or smaller than approximately half of the diameter S of the ingot G, and a normal (thicker) diameter portion of the wire 1 is used where the cutting length T is larger than approximately half of the diameter S.

As a result, the thickness of the wafers W becomes substantially uniform, as shown in FIG. 2B.

In the present embodiment, the used portion of the wire 1 is reused in order to change the wire diameter.

After an ingot G is cut, part of the used portion of the wire 1 in the wire winder-side Y is rewound to the wire feeder-side X, and the rewound portion of the wire 1 is used at the beginning of slicing of a new ingot G.

The amount of rewinding is adjusted such that a new portion of the wire is used when the cutting length becomes larger than approximately S/2.

Alternatively, the wire 1 is moved in the reverse direction and the used portion of the wire is used again. When the wire is moved one way, the moving direction is simply reversed.

When the wire is moved reciprocally, the reciprocation timing is changed so that the overall moving direction of the wire is reversed. When the cutting length T becomes S/2 for the first time after the beginning of slicing, the used portion of the wire 1 is pulled out within a short period of time, and a new portion of the wire 1 is used for slicing.

When the slicing approaches the end and the cutting length T becomes S/2 or less than S/2, the moving direction of the wire is reversed so as to reuse the used portion of the wire 1. Alternatively, the used portion of the wire 1 is rewound within a short period of time, and the used portion of the wire 1 is used again.

In the slicing method according to the present invention, a die may be used to reduce the diameter of a portion of the wire 1. Examples of dies usable in the slicing method include a pulling die with a certain diameter hole, and a roller die comprising a pair of rollers with a semi-circular groove in each. The ratio of diameter reduction provided by the die is, for example, equal to or less than 2% of the diameter of a new wire.

Figure 4:
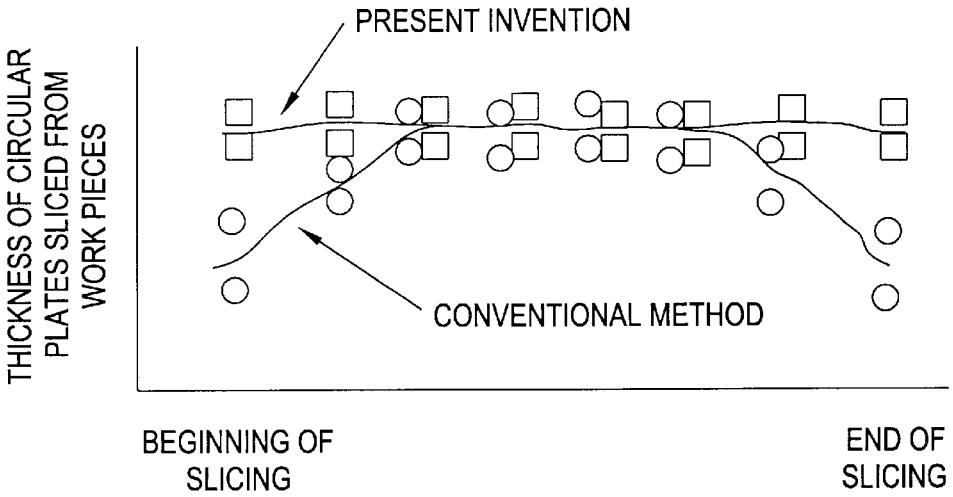
FIG. 4 is a diagram illustrating the result of a test showing the effect of the slicing method according to the present invention, wherein the ordinate represents the thickness of circular plates sliced from a workpiece, and the abscissa represents the cutting depth (the left end represents the beginning of slicing, while the right end represents the end of slicing)

Test results of the above-described cutting are shown in FIG. 4. In FIG. 4, the ordinate represents the thickness of the sliced workpiece and the abscissa represents the cutting depth (the left end represents the beginning of slicing, while the right end represents the end of slicing). The circles represent data from the conventional method, while the squares represent data from the slicing method of the present invention.

These test results show that the wafers W sliced by the present invention method have a more uniform thickness compared with wafers sliced by the conventional method in which the wafers become thinner at the beginning and end of cutting.

The present invention is not limited to the above-described embodiment. The above-described embodiment is a mere example, and those having the substantially same structure as that described in the appended claims and providing the similar action and effects are included in the scope of the present invention.

What is claimed is:

1. A method of slicing a cylindrical workpiece with a wire saw including pressing the workpiece against a moving wire so as to slice plates having substantially circular cut surfaces, the method comprising the steps of:

a) slicing a first portion of the workpiece having a first cutting length which is shorter than a predetermined length using a first portion of said wire at a beginning of slicing; and b) subsequently to step (a) slicing a second portion of the workpiece having a second cutting length which is longer than the predetermined length using a second portion of the wire which is thicker than the first portion of the wire.

2. A method of slicing a cylindrical workpiece with a wire saw according to claim 1, wherein said wire is wound so as to use a used portion of said wire as the first portion of said wire for cutting the first portion of the workpiece having a first cutting length which is shorter than the predetermined length.

3. A method of slicing a cylindrical workpiece with a wire saw according to claim 1, wherein a moving direction of said wire is reversed so as to use a used portion of said wire as the first portion of said wire for cutting the first portion of the workpiece having a first cutting length which is shorter than the predetermined length.

4. A method of slicing a cylindrical workpiece with a wire saw according to claim 1, wherein a die is used for making the first portion of said wire.

5. A method of slicing a cylindrical workpiece with a wire saw according to claim 1, wherein the first portion of said wire is used at the beginning of slicing until the cutting length of the workpiece becomes greater than approximately 50% of an outer diameter of the workpiece.

6. A method of slicing a cylindrical workpiece with a wire saw according to claim 1, wherein said cylindrical workpiece is a semiconductor ingot.

7. A method of slicing a cylindrical with a wire saw according to claim 1, wherein said cylindrical workpiece is a semiconductor silicon ingot.

8. A method of slicing a cylindrical workpiece with a wire saw including pressing a workpiece against a moving wire so as to slice plates having substantially circular cut surfaces, the method comprising the steps of:

slicing a first portion of the workpiece having a first cutting length which is shorter than a predetermined length using a first portion of said wire at an end of slicing; and slicing a second portion of the workpiece having a second cutting length which is longer than the predetermined length with a second portion of the wire, the first portion of said wire being thinner than the second portion of said wire.

9. A method of slicing a cylindrical workpiece with a wire saw according to claim 8, wherein said wire is wound so as to use a used portion of said wire as the first portion of said wire for cutting the first portion of the workpiece having a first cutting length which is shorter than the predetermined length.

10. A method of slicing a cylindrical workpiece with a wire saw according to claim 8, wherein the first portion of said wire is used near the end of slicing after the cutting length of the workpiece becomes equal to or less than approximately 50% of an outer diameter of the workpiece.

11. A method of slicing a cylindrical workpiece with a wire saw according to claim 8, wherein said cylindrical workpiece is a semiconductor ingot.

12. A method of slicing a cylindrical with a wire saw according to claim 8, wherein said cylindrical workpiece is a semiconductor silicon ingot.

13. A method of slicing a cylindrical workpiece with a wire saw including pressing a cylindrical workpiece against a moving wire so as to slice plates having substantially circular cut surfaces, the method comprising the steps of:

a) slicing a first portion of the workpiece having a first cutting length which is shorter than a predetermined length using a first portion of said wire at a beginning of slicing;

b) subsequently to step (a) slicing a second portion of the workpiece using a second portion of said wire which is thicker than the first portion of said wire, the second portion of the workrpiece having a second cutting length which is longer than the predetermined length; and c) subsequently to step (b) slicing a third portion of the workpiece using a third portion of said wire which is thinner than the second portion of said wire as slicing approaches to an end of slicing, the third portion of the workpiece having a cutting length which is equal to or shorter than the predetermined length.

14. A method of slicing a cylindrical workpiece with a wire saw according to claim 13, wherein said wire is wound so as to use a used portion of said wire as at least one of the first portion and the third portion of said wire for cutting the first portion and the third portion of the workpiece, respectively.

15. A method of slicing a cylindrical workpiece with a wire saw according to claim 13, wherein a moving direction of said wire is reversed so as to use a used portion of said wire as at least one of the first portion and the third portion of said wire for cutting the first portion and the third portion, respectively, of the workpiece.

16. A method of slicing a cylindrical workpiece with a wire saw according to claim 13, wherein the first portion of said wire is used at the beginning of slicing until the cutting length of the workpiece becomes greater than approximately 50% of an outer diameter of the workpiece.

17. A method of slicing a cylindrical workpiece with a wire saw according to claim 13, wherein the third portion of said wire is used near the end of slicing after the cutting length of the workpiece becomes equal to or less than approximately 50% of an outer diameter of the workpiece.

18. A method of slicing a cylindrical with a wire saw according to claim 13, wherein said cylindrical workpiece is a semiconductor ingot.

19. A method of slicing a cylindrical with a wire saw according to claim 13, wherein said cylindrical workpiece is a semiconductor silicon ingot.

* * * * *